US007770635B2

(12) United States Patent
Angman

(10) Patent No.: US 7,770,635 B2
(45) Date of Patent: Aug. 10, 2010

(54) WELLBORE TUBULAR HANDLING TORQUE MULTIPLIER

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 202 days.

(21) Appl. No.: 11/718,779

(22) PCT Filed: Nov. 8, 2005

(86) PCT No.: PCT/CA2005/001712

§ 371 (c)(1),
(2), (4) Date: May 7, 2007

(87) PCT Pub. No.: WO2006/047892

PCT Pub. Date: May 11, 2006

(65) Prior Publication Data

US 2008/0093127 A1 Apr. 24, 2008

Related U.S. Application Data

(60) Provisional application No. 60/522,790, filed on Nov. 8, 2004.

(51) Int. Cl.
*E21B 19/18* (2006.01)

(52) U.S. Cl. ..... 166/77.51; 166/85.1; 175/195

(58) Field of Classification Search ..... 175/170, 175/195; 166/77.51, 380, 85.1, 78.1; 173/216, 173/178, 213
See application file for complete search history.

(56) References Cited

U.S. PATENT DOCUMENTS

| | | | | |
|---|---|---|---|---|
| 3,598,188 | A | 8/1971 | Foster | |
| 3,623,558 | A | 11/1971 | Brown | |
| 3,757,605 | A | 9/1973 | Morden | |
| 3,901,330 | A | 8/1975 | Slator et al. | |
| 4,100,968 | A * | 7/1978 | Delano | 166/380 |
| 4,222,445 | A | 9/1980 | Vadetsky | |
| 4,434,862 | A | 3/1984 | Lyons | |
| 4,485,692 | A | 12/1984 | Moore et al. | |
| 4,548,273 | A | 10/1985 | Leicht et al. | |
| 4,564,068 | A | 1/1986 | Baugh | |
| 4,984,641 | A | 1/1991 | Pryor | |
| 5,080,642 | A | 1/1992 | Takami | |
| 5,269,734 | A | 12/1993 | Menge, Sr. | |

(Continued)

FOREIGN PATENT DOCUMENTS

| | | |
|---|---|---|
| EP | 0727560 | 8/1996 |

OTHER PUBLICATIONS

Casing Drive Systems, TESCO Corporation, Bulletin 41000e, Apr. 2004.

*Primary Examiner*—David J Bagnell
*Assistant Examiner*—Cathleen R Hutchins
(74) *Attorney, Agent, or Firm*—Bracewell & Giuliani LLP

(57) ABSTRACT

A tubular handling torque multiplier includes a torque input end for connection to the quill of a top drive, a torque output end for connection at least indirectly to a well tubular joint to be driven to rotate, gears for adjusting the torque output from the torque output end from that torque input at the torque input end, an axial support between the torque input end and the torque output end to allow axial stress to be communicated from the torque output end to the torque input end and a fluid circulating path open between the torque input end and the torque output end.

19 Claims, 2 Drawing Sheets

U.S. PATENT DOCUMENTS

| | | | | |
|---|---|---|---|---|
| 5,309,778 | A | 5/1994 | Antonov | |
| 5,429,198 | A | 7/1995 | Anderson et al. | |
| 5,433,279 | A * | 7/1995 | Tessari et al. | 173/213 |
| 5,803,191 | A * | 9/1998 | Mackintosh | 175/170 |
| 6,824,490 | B2 | 11/2004 | Suzuki et al. | |
| 6,824,491 | B2 | 11/2004 | Chen | |
| 2002/0040613 | A1 | 4/2002 | Brooks | |
| 2004/0037710 | A1 * | 2/2004 | Stewart et al. | 417/273 |
| 2004/0177971 | A1 | 9/2004 | Seneviratne | |
| 2004/0195004 | A1 * | 10/2004 | Power et al. | 175/24 |

* cited by examiner

WELLBORE TUBULAR HANDLING TORQUE MULTIPLIER

CROSS REFERENCE TO RELATED APPLICATIONS

This application claims priority to U.S. provisional patent application Ser. No. 60/522,790, filed Nov. 8, 2004.

FIELD OF THE INVENTION

The present invention relates to a device for modifying torque application in a well bore operation.

BACKGROUND OF THE INVENTION

Top drives have been used to handle wellbore tubulars such as pipe, casing including casing joints and strings of casing joints and other wellbore liners during wellbore operations such as casing drilling and casing running operations. The use of a top drive to handle tubulars, although common, may exhibit some disadvantages especially when the top drive is operated at low rpm conditions. For example, some top drives have limitations on motor size and control which reduce their effectiveness for handling all or some tubular sizes and types of connections. As another example, in some applications a top drive may tend to stall, create torque ripples, etc. during the handling of tubulars.

SUMMARY OF THE INVENTION

In one aspect of the present invention, there is provided a tubular running torque multiplier, comprising: a torque input end for connection to the quill of a top drive, a torque output end for connection at least indirectly to a well tubular joint to be driven to rotate, gears for adjusting the torque output from the torque output end from that torque input at the torque input end, an axial support between the torque input end and the torque output end to allow axial stress to be communicated from the torque output end to the torque input end and a fluid circulating path open between the torque input end and the torque output end.

In another aspect of the present invention, there is provided: a well tubular handling system comprising: a vertically movable power drive assembly for providing rotary movement in a well device; a longitudinally extending power drive output shaft rotatably turned about its longitudinal axis by the power drive assembly and movable vertically therewith; a pipe gripping mechanism having a lower end selected to grip and rotate an end of well tubular; and, a tubular running torque multiplier connected between the power drive output shaft and the pipe gripping mechanism and communicating rotational drive from the power drive output shaft to the pipe gripping mechanism, the tubular running torque multiplier including gears for causing any rotational speed of the pipe gripping mechanism to be less or greater than that of the power drive output shaft.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

A torque multiplier may be used for tubular handling such as during casing running during or after drilling.

Figure 1:
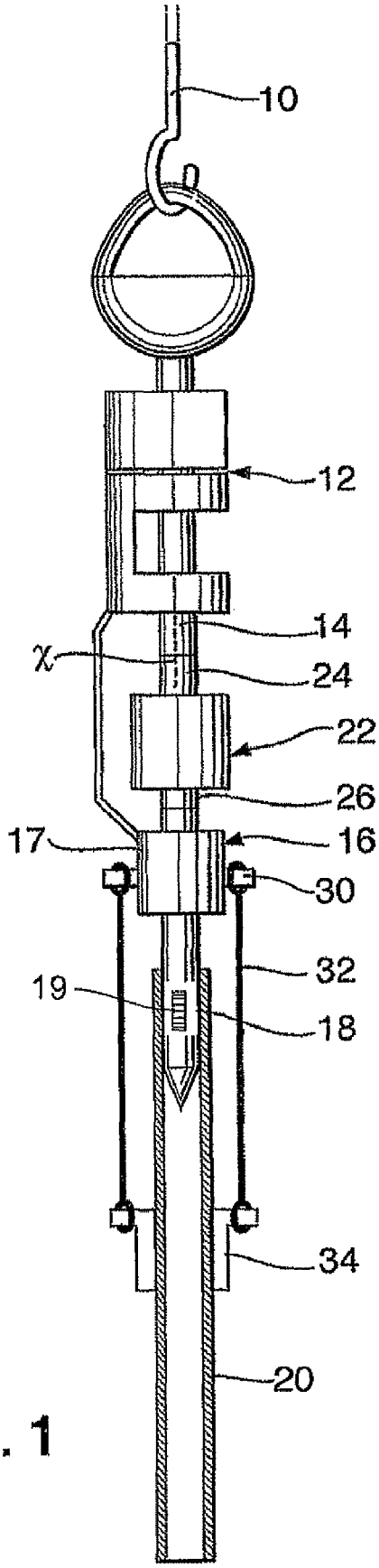
FIG. 1 is a schematic view of a well tubular handling system, including a torque multiplier, installed in a derrick.

Referring to FIG. 1, a well tubular handling system according to one aspect of the present invention is shown. The well tubular handling system may be mounted in the derrick by a hook 10 and other components for vertical movement therein. The well tubular handling system in one embodiment, as illustrated, includes top drive 12, which is a power drive assembly for providing rotary movement through its longitudinally extending power drive output shaft 14, which is commonly known as a quill. Quill 14 is rotatably turned about its longitudinal axis x by the top drive and is movable vertically therewith. The well tubular handling system, in this embodiment, further includes a pipe gripping mechanism 16 having a lower end 18 selected to grip and rotate a tubular such as, for example, a well casing 20, which may be a single joint or a string thereof. A torque multiplier 22 is connected directly or indirectly between the quill of top drive 12 and the pipe gripping mechanism 18. The tubular running torque multiplier 22 is formed to communicate rotational drive from the quill to the pipe gripping mechanism and includes gears (cannot be seen in FIG. 1) for causing any rotational speed from the quill applied to the torque multiplier to be reduced and/or increased as it is communicated therethrough to the pipe gripping mechanism.

In many applications, it may be useful that the rotational speed of the quill be reduced by torque multiplier 22 so that pipe gripping mechanism 16 rotates at a speed less than the quill, which consequently causes the torque output at the pipe gripping mechanism to be greater than the torque input to the torque multiplier by the quill.

Torque multiplier 22 may include a torque input end 24 for connection directly, as shown, or indirectly, as by use of a one or more subs inserted therebetween, to the quill. A torque output end 26 is formed opposite the torque input end 24 for connection directly, as shown, or indirectly, as by use of a one or more subs inserted therebetween, to the pipe gripping mechanism. Torque multiplier 22 is generally separable from its connection below the top drive so that the top drive can be operated with or without the torque multiplier installed therebelow and the torque multiplier may be moved from top drive to top drive as it is needed. In one embodiment, the torque multiplier may be integrated, as by permanent connection to or by forming as a combined unit with, the pipe gripping mechanism. In one such embodiment, the torque multiplier may be formed integral with a housing, such as the housing of the mechanism's actuator 17. By integrating the pipe gripping device and the torque multiplier, they may be handled on the rig as a single portable component.

Torque multiplier 22 may be formed to transmit the full weight of any pipe gripping mechanism 16 and any casing joints 20 engaged by mechanism 16 that is supported on the output end to input end 24, in such a way that the load is transferred through the torque multiplier to the top drive quill 14. The torque multiplier may, therefore, include axial supports, bearings, etc. to transmit the load.

The tubular handling torque multiplier may further include any or all of the following: a clutch to limit output torque from the tubular handling torque multiplier to the pipe gripping mechanism, a torque sensor and/or a rotational speed sensor for monitoring well tubular make-up.

Since it is common to circulate fluid through the well during a casing running operation, the tubular handling torque multiplier may further accommodate a fluid circulating path between the top drive and the pipe gripping mechanism.

Various forms of top drives and pipe gripping mechanisms are useful in the present invention. Top drives, for example, are available from many manufacturers, including for example TESCO Corporation, and in many sizes and ratings, as will be appreciated.

Pipe gripping mechanism 16 is selected to grip a tubular such as a casing joint or string thereof for rotation thereof. In the illustrated embodiment, an internal pipe gripping device is shown including actuator 17 for driving dies 19 on lower end 18 into and out of physical engagement with the inner diameter surface of casing 20. In the illustrated embodiment, pipe gripping device 16 supports link hangers 30 and links 32 carrying an elevator 34 for handling casing. Of course, although this pipe gripping mechanism is illustrated, it is to be understood that it can be modified in various ways. For example, pipe gripping devices are available that operate in various ways, as by internal gripping, as shown, and external gripping and by use of frictional engagement, as by inflatable packers, expandable bodies, etc., physical engagement, as by use of dies, etc. While many pipe gripping devices are available, some pipe gripping devices are shown, for example, in applicant's corresponding patents U.S. Pat. No. 6,311,792, issued November, 2001 and U.S. Pat. No. 6,742,584, issued June, 2004.

Figure 2:
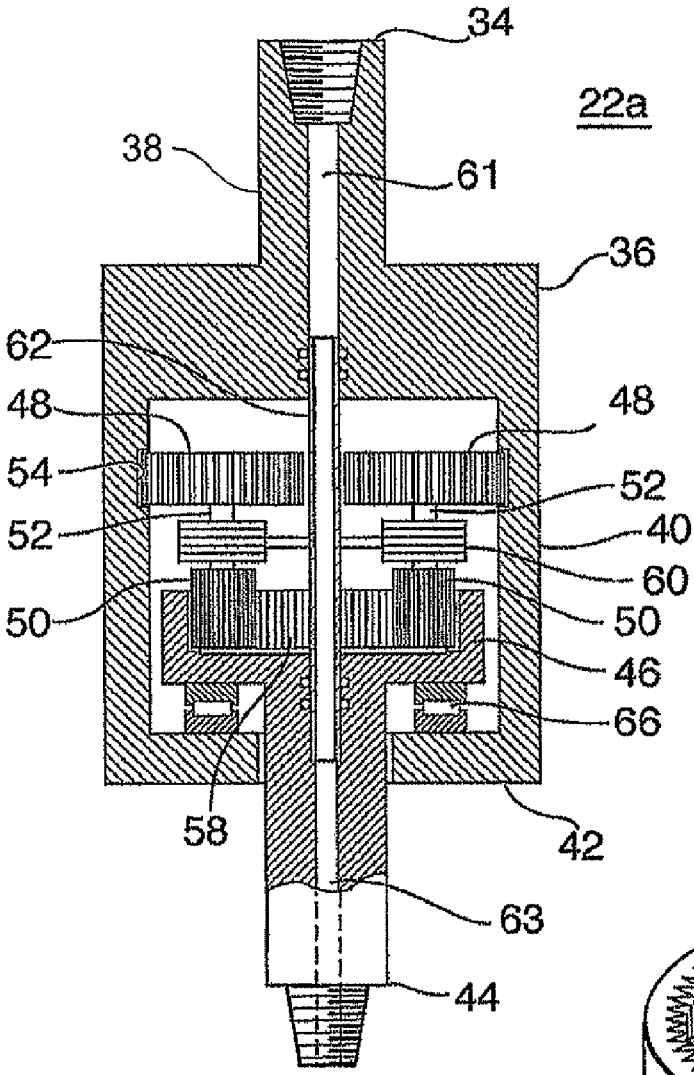
FIG. 2 is a sectional view of a torque multiplier according to one aspect of the present invention.
Figure 3:
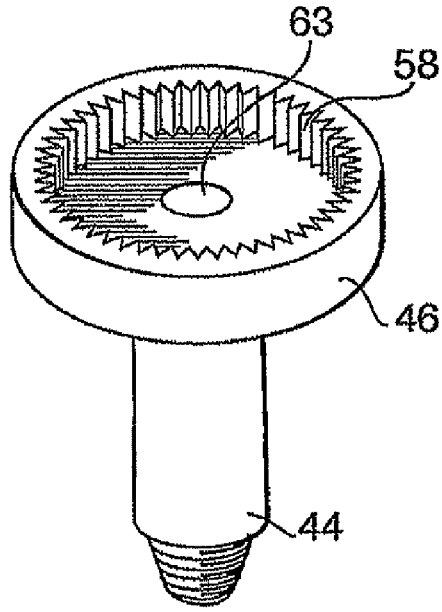
FIG. 3 is a perspective view of an output shaft useful in the present invention.

With reference to FIGS. 2 and 3, one possible embodiment of a casing running torque multiplier 22*a* is shown schematically. Casing running torque multiplier 22*a* may include a housing 36 defining an input end and an output end. The input end includes an input shaft 38, sidewalls 40, and a return 42. The output end, in this illustrated embodiment, includes an output shaft 44 and body 46. Casing running torque multiplier 22*a* may further include a first gear 48 and a second gear 50 acting between the input end and the output end.

Input shaft 38 may be formed for connection to a top drive for rotational drive input and output shaft 44 may be formed for connection at least indirectly to a casing joint to be driven to rotate. In the illustrated embodiment, for example, shafts 38, 44 include threads to facilitate these connections.

Rotational drive is communicated from input shaft 38 to output shaft 44 through the torque multiplier. In particular, in this embodiment, shaft 38 and other parts of the input end, including sidewalls 40 and return 42 are formed integral or connected to transmit rotation therethrough. First gear 48 is in communication with, for accepting rotational drive from, the side walls 40 of input end, the second gear is in drive communication with the first gear and the output end is in communication with second gear 50 for accepting rotational drive from the second gear.

In the illustrated embodiment, a portion 54 of the side walls 40 form a gear that enmeshes with first gear 48, for example, as in a planetary gear configuration. The first gear may include a plurality of gear wheels, as shown, such as, for example, three.

Second gear 50 may be connected in various ways to the first gear for drive communication therewith. For example, the first gear and the second gear may be in communication by one or more further gears disposed therebetween. In another possible embodiment, the first gear and the second gear may be linked by a drive shaft 52, as shown, that conveys the rotational energy of the first gear to the second gear. The second gear may also include a plurality of gear wheels, as shown, such as, for example, three.

First gear 48 and second gear 50 may define a gear ratio therebetween. Since one useful gear ratio may increase the torque of any rotational energy from the input end to the output end, in one embodiment, first gear 48 is a larger gear than second gear 50. The torque multiplier may have a set gear ratio or a gear ratio that is selectable, for example, from a range of options.

The second gear and the output end may be formed in various ways to communicate rotational drive therebetween. In one embodiment, the output end is formed with shaft 44 and body 46 connected or formed integral such that rotation of body 46 translates to rotation of shaft 44. Body 46 may be formed for engagement by the second gear for transmitting rotational drive from the second gear to the output shaft. For example, in one embodiment, the body may define gear teeth 58 that may be enmeshed with the second gear, for example, as in a planetary gear configuration.

The torque multiplier may be used with a clutch, since a clutch may provide torque control, selection of constant torque and/or define an upper torque limit for output torque from shaft 44. The clutch may be selected for instantaneous operation and may be installed in various locations such as in subs or devices above or below the torque multiplier, for example attached at either the input or the output ends or it may be incorporated or carried on the torque multiplier. In one embodiment, as shown, a clutch 60 may be positioned to act between the input end and the output end. In one embodiment, clutch 60 may operate between the first gear and the second gear. Of course, a clutch may not be useful if the torque limit on the top drive is sufficiently sensitive.

As noted above, the gears of the torque multiplier may be rearranged to facilitate gear sizing while still achieving torque multiplication. In one embodiment, for example, a torque multiplier might be useful that represented an inverted version of the tool of FIG. 2. In particular, the torque multiplier could include an input shaft on its upper end that was in communication with a gear cut on the outside of the shaft. A second gear (similar in size to the input shaft diameter) would be positioned between the input shaft gear and the internal gear on the housing. This embodiment may provide permit larger gears to be used, which can be more easily supported. However, this arrangement may require a top drive to be operated in reverse in order to achieve an appropriate direction of rotation at the output end.

The torque multiplier may accommodate many of the standard mechanisms employed in casing handling, such as a torque arrest, thread compensation, torque and turn measurement, torque and rotational speed sensors, and/or fluid circulation. For example, a fluid conduit may be formed through the torque multiplier, as by a bore 61 through input end, a bore 63 through output end and a fluid spear 62 extending in sealing configuration therebetween, or by employing other mechanisms or configurations.

An axial load support may be provided between the input end and the output end to allow axial stress to be communicated from the output end to the input end. In the illustrated embodiment, return 42 acts as a shoulder to support body 46 of the output end and accepts a stress load therefrom which is communicated to input shaft 34. Bearings, such as for example swivel bearings 66, may be used to facilitate operation and relative rotation of the input end vs. the output end.

A releasable lock mode could be provided on the torque multiplier to permit the unit to be operated with the input end rotationally locked to the output end, should that be desirable for certain operations.

The torque multiplier may be used to apply high torque loads to a casing joint or string but could be used to prevent over torquing. Top drive inertia and motor torque ripples may be addressed by use of the torque multiplier.

In operation, the top drive could be run at higher rpms, such that stall conditions could be avoided.

The previous description of the disclosed embodiments and examples is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. Specifically with respect to the United States, no claim element is to be construed under the provisions of 35 USC 112, sixth paragraph, unless the element is expressly recited using the phrase "means for" or "step for".

I claim:

1. A well tubular handling system, comprising:

a vertically movable power drive assembly for providing rotary movement in a well device;

a longitudinally extending power drive output shaft rotatably turned about a longitudinal axis of the power drive output shaft by the power drive assembly and movable vertically therewith;

a pipe gripping mechanism having a die on a lower end selected to grip and rotate an end of a well tubular;

a tubular handling torque multiplier connected between the power drive output shaft and the pipe gripping mechanism and communicating rotational drive from the power drive output shaft to the pipe gripping mechanism, the tubular handling torque multiplier including gears for causing a rotational speed of the pipe gripping mechanism to be less than or greater than that of the power drive output shaft; wherein the torque multiplier has an input shaft connected by threads to the power drive output shaft so that weight supported by the pipe gripping mechanism passes through the input shaft of the torque multiplier to the power drive output shaft;

the torque multiplier has an output shaft for driving the pipe gripping mechanism;

the input and output shafts of the torque multiplier having passages therethrough; and wherein the passages are in sealing engagement with each other to enable fluid to be transmitted through the torque multiplier without contact with the gears.

2. The well tubular handling system of claim 1 wherein the tubular handling torque multiplier further comprising:

a housing surrounding the gears. the housing being rotatable in unison with one of the input and output shafts of the torque multiplier.

3. The well tubular handling system of claim 1 further comprising a conduit extending sealingly between the passages.

4. The well tubular handling system of claim 1 wherein the gears of the tubular handling torque multiplier include a first gear and a second gear defining therebetween a gear ratio.

5. The well tubular handling system of claim 4 wherein the tubular handling torque multiplier further includes a clutch operationally mounted between the first and second gears to limit output torque from the tubular handling torque multiplier to the pipe gripping mechanism.

6. The well tubular handling system of claim 1, further comprising:

a conduit extending sealingly between the passages; and wherein the conduit rotates in unison with one of the shafts of the tubular handling torque multiplier, the other of the shafts of the tubular handling toque multiplier rotates relative to the conduit.

7. The well tubular handling system of claim 1 wherein the tubular handling torque multiplier accommodates a torque sensor for monitoring well tubular make-up.

8. The well tubular handling system of claim 1 wherein the tubular handling torque multiplier accommodates a rotational speed sensor for monitoring well tubular make-up.

9. The well tubular handling system of claim 1 further comprising:

a housing surrounding the gears, the housing being rotatable in unison with a first one of the input and output shafts of the torque multiplier, a second one of the input and output shafts being rotatable relative to the housing; and a bearing between the housing and the second one of the input and output shafts.

10. A tubular handling torque multiplier, comprising:

a gear housing;

a torque input shaft having an upper threaded end for connection to a quill of a top drive, the torque input shaft having an axis and an axially extending inlet passage therethrough, the inlet passage having a lower end within the gear housing;

a torque output shaft having a threaded end for connection to a pipe gripping mechanism, the torque output shaft being coaxial with the torque input shaft and having an axially extending outlet passage therethrough, the outlet passage having an upper end within the gear housing and spaced below the lower end of the inlet passage;

gears intermeshing with each other and located in the gear housing between the torque input shaft and torque output shaft for changing the torque output at the torque output shaft from the torque input at the torque input shaft;

a set of bearings between one of the torque input shaft and the torque output shaft and the gear housing to enable rotation of said one of the torque input and torque output shafts relative to the gear housing and to allow axial load on the torque output shaft to be communicated from the torque output shaft to the torque input shaft and from the torque input shaft to the quill of the top drive; and the lower end of the inlet passage and the upper end of the outlet passage are in sealing engagement with each other and isolated from the gears to enable fluid to be pumped through the inlet and outlet passages without contacting the gears.

11. The tubular handling torque multiplier of claim 10 further comprising:

a conduit extending sealingly between the inlet and the outlet passages.

12. The tubular handling torque multiplier of claim 10 wherein:

the gears of include a first gear and a second gear defining therebetween a gear ratio; and the gear housing rotates in unison with one of the first and second gears.

13. The tubular handling torque multiplier of claim 12 wherein the gear housing also rotates in unison with one of the shafts.

14. The tubular handling torque multiplier of claim 12 further comprising a clutch operationally located between the first and second gears to limit output torque at the torque output end.

15. The tubular handling torque multiplier of claim 10, further comprising:

a fluid conduit extending sealing between the inlet and outlet passages; and wherein the fluid conduit rotates in unison with one of the shafts, and the other of the shafts rotates relative to the fluid conduit.

16. The tubular handling torque multiplier of claim 10 further comprising a torque sensor for monitoring well tubular make-up.

17. The tubular handling torque multiplier of claim 10 further comprising a rotational speed sensor for monitoring well tubular make-up.

18. The tubular handling torque multiplier of claim 10 wherein:

the gear housing is connected to one of the shafts for rotation therewith, the housing having a base with an opening therein;

the other of the shafts extends through the opening and is rotatable relative to the housing.

19. A well pipe handling system, comprising:

a torque multiplying unit having an input shaft with a threaded end extending upward from the unit for securing to a drive shaft of a top drive of a drilling rig for rotation therewith;

an output shaft on the unit that has a threaded end extending downward;

a gear train in the unit operationally between the input shaft and the output shaft for transferring rotation of the input shaft to the output shaft, the gear train having a selected ratio to cause the output shaft to rotate at a different speed than the input shaft;

a pipe gripping mechanism having an upper end that secures to the output shaft of the unit for rotation therewith, the pipe gripping mechanism having dies that are movable into and out of physical engagement with a well pipe for supporting and transmitting rotation to the pipe;

an inlet fluid passage in the input shaft and an outlet fluid passage in the output shafts, the inlet fluid passage having a lower end spaced above an upper end of the outlet fluid passage;

a tube extending between the lower end of the inlet fluid passage and the outlet fluid passage to allow fluid to be transmitted through the passages without contact with the gear train; and wherein weight supported by the pipe gripping mechanism is transferred through the output shaft to the drive shaft of the top drive.

* * * * *